United States Patent [19]

Schexnayder

[11] 4,000,683

[45] Jan. 4, 1977

[54] HYDRAULIC LOAD LIFTING SYSTEM

[75] Inventor: Lawrence F. Schexnayder, Joliet, Ill.

[73] Assignee: Caterpillar Tractor Co., Peoria, Ill.

[22] Filed: May 27, 1975

[21] Appl. No.: 581,297

[52] U.S. Cl. ..... 91/411 R; 91/445; 91/447

[51] Int. Cl.[2] ..... F15B 11/16; F15B 13/042; F15B 13/06

[58] Field of Search ..... 91/445, 447, 411, 411 B; 137/596.15, 596.2

[56] References Cited

UNITED STATES PATENTS

| | | | |
|---|---|---|---|
| 2,974,637 | 3/1961 | Holmes et al. | 91/447 X |
| 3,127,688 | 4/1964 | Hein et al. | 91/445 X |
| 3,494,259 | 2/1970 | Sumida | 91/411 R |
| 3,728,941 | 4/1973 | Cryder | 91/447 |
| 3,805,678 | 4/1974 | Bianchetta et al. | 91/447 |

FOREIGN PATENTS OR APPLICATIONS

| | | | |
|---|---|---|---|
| 1,922,073 | 11/1970 | Germany | 91/447 |

*Primary Examiner*—Irwin C. Cohen
*Attorney, Agent, or Firm*—Ralph E. Walters

[57] ABSTRACT

A hydraulic load lifting system having a vented load check valve disposed in the main control line connected between the load supporting end of a hydraulic motor and a spool-type control valve to normally isolate the load generated pressures from the control valve is provided with venting apparatus which is operative to selectively prepressurize the main control line between the control valve and the load check valve prior to the venting of the load check valve and the shifting of the control valve to effect the lowering of a load being supported by the hydraulic motor so as to substantially balance the pressures on the opposite sides of the load check valve to prevent momentary load drop and hydraulic hammering.

12 Claims, 5 Drawing Figures

HYDRAULIC LOAD LIFTING SYSTEM

BACKGROUND OF THE INVENTION

Hydraulic systems frequently employ a hydraulic motor to raise and lower relatively heavy loads and at times to support such loads in an elevated position. When the motor is required to support the load in such elevated position, it is normally desirable to isolate the relatively high load generated pressure in the load supporting end of the motor from the remainder of the system. This is to prevent the downward drifting of the load due to leakage past the valve spools of the conventional control valves normally used in such systems. The load pressure is also normally isolated for safety purposes to prevent the sudden dropping of the load in the event of a line failure or the like.

This isolation is normally accomplished by the disposition of a load check valve in the motor line near or preferably at the load supporting end of the motor. Such load check valve permits free flow of fluid to the motor, but normally prevents the escape of fluid therefrom. Thus when it is desired to lower the load, it is necessary to permit the load check valve to open so that fluid may be discharged from the load supporting end of the motor. For a vented-type check valve popularly used, this is accomplished, as more fully described in U.S. Pat. No. 3,127,688 to Hein et al, by simultaneously venting the pressure holding the load check valve closed when the control valve is actuated to its load lowering position.

While the use of load check valves is normally essential, they have in the past had many adverse effects on the load lifting systems in which they are employed. One problem commonly associated with their use is hydraulic hammering. It will be appreciated that because the load check valve is so effective in isolating the pressure at the load supporting end of the motor, the pressure thereat is sometimes extremely high due to a heavy load, whereas the pressure on the control valve side of the load check valve is relatively low. As a result, when the load check valve pops open as is normally the case, a tremendous pressure surge occurs towards the control valve causing such hammering. The severity of the hammering is frequently such to cause a loud audible bang throughout the system. In addition, the pressure waves created thereby tend to reverberate causing an undesirable fluttering of the load check valve which in turn makes the lowering of the load erratic and difficult to control. Also associated with the quick release of the high pressure from the motor is the relatively small but sudden drop of the load before the balance of pressure occurs.

Another problem commonly associated with the use of load check valves is that when a heavy load is being lowered and the control valve is shifted to neutral to stop such lowering, the load check valves will normally pop closed preventing further escape of fluid from the motor. When this happens, the weight and momentum of the load causes an extremely high pressure spike to occur in the motor which can be injurious to the motor and its various components.

In earthmoving vehicles, such as a hydraulic excavator and the like, where two or more hydraulic motors are connected in unison for raising and lowering the load, it is desirable that the pressures in each of the motors be equal so as to prevent uneven operation and the cocking of the excavator's boom. As the load check valve normally prevents this pressure equalization, a separate small equalizer line has been used in the past which bypasses the load check valves so as to permit such pressure equalization. However, the addition of such equalizer line not only adds to the complexity of the system, but also adds another line which is susceptible to breakage or rupture during operation to cause the disablement of the system.

SUMMARY AND OBJECTS OF THE INVENTION

Accordingly, it is an object of this invention to provide apparatus for a hydraulic load lifting system utilizing a load check valve at the load supporting end of a hydraulic motor which apparatus is effective in alleviating the momentary load drop and hydraulic hammering commonly occuring when such load check valve opens to permit the lowering of the load.

Another object of this invention is to provide such apparatus which further alleviates the occurrence of a high pressure spike in the hydraulic motor when the lowering of a heavy load is abruptly stopped in mid air.

Another object of this invention is to provide apparatus for equalizing the pressure between the load supporting ends of a pair of such hydraulic motors which are used to raise and lower the load in unison without the use of a separate equalizer line interconnecting such ends.

Other objects and advantages of the present invention will become more readily apparent upon reference to the accompanying drawings and following description.

DESCRIPTION OF THE PREFERRED EMBODIMENT

Figure 1:
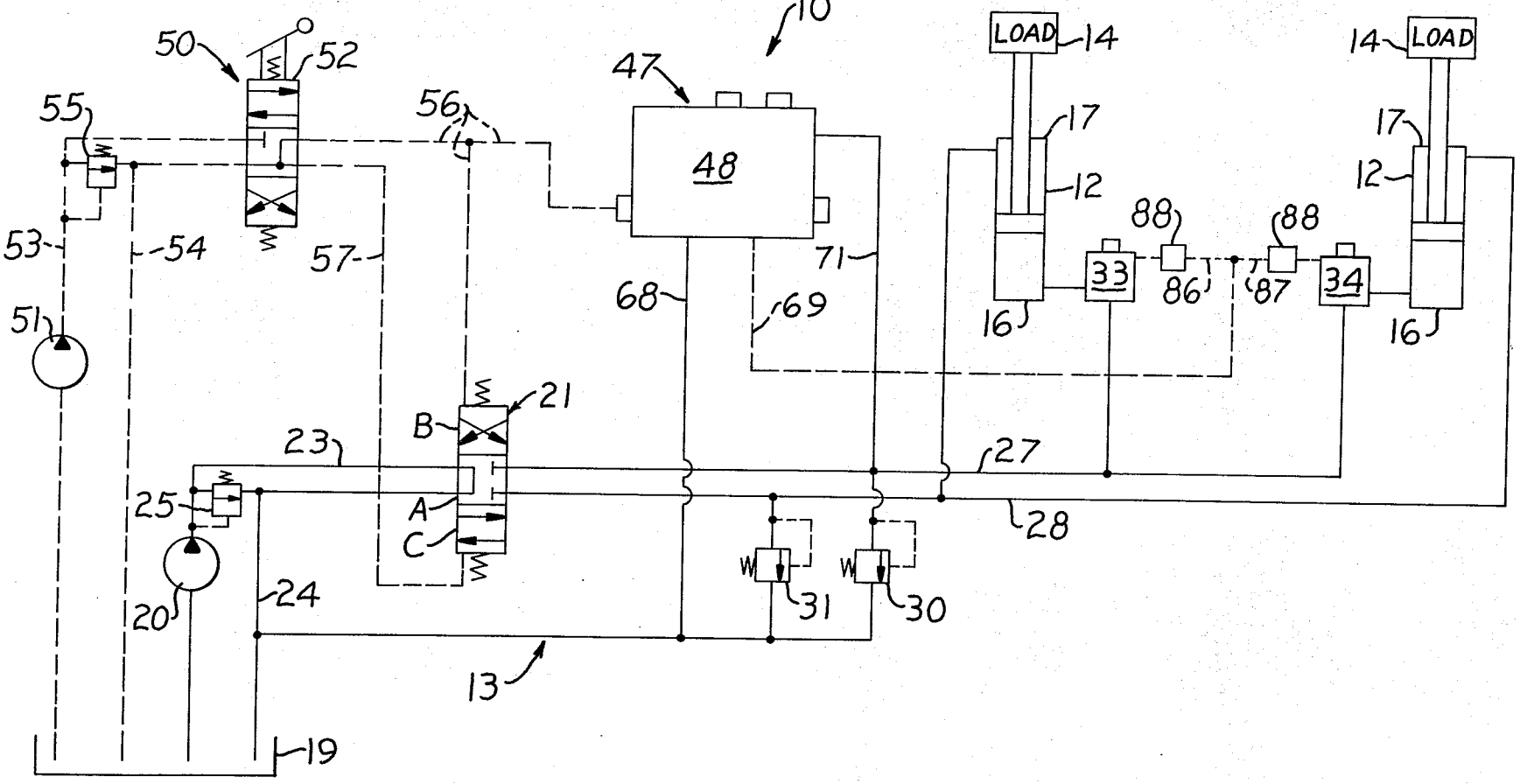
FIG. 1 is an overall schematic circuit diagram of a hydraulic load lifting system constructed in accordance with the principles of the present invention.

Referring more particularly to the drawings, a hydraulic load lifting system embodying the principles of the present invention is shown schematically in FIG. 1 and is generally represented by the reference numeral 10. Such system generally includes load supporting hydraulic motor means, such as a pair of hydraulic jacks 12 and a control circuit 13 operatively connected to control the extension of such jacks for raising a load 14 and the retraction thereof for lowering the load. The jacks each include a load supporting or head end 16 and an opposite rod end 17.

The control circuit 13 includes a fluid reservoir 19, a main pump 20 connected for drawing fluid from the reservoir and a pilot operated main control valve 21. A pump line 23 connects the pump 20 to the control valve. The control valve is selectively positionable between a neutral or hold position A and either of two operative positions B and C. The control valve 21 communicates with the reservoir 19 by way of a tank line 24. A relief valve 25 selectively controls communication between the pump line 23 and the tank line 24 to limit the maximum pressure in the control circuit between the pump and the control valve 21. The control valve is further individually connected to the head ends 16 and the opposite rod ends 17 of the jacks 12 by main control lines 27 and 28, respectively. A pair of main line relief valves 30 and 31 are individually connected to their respective main control lines 27 and 28 to limit the maximum pressure in the control circuit on the jack side of the control valve 21.

A pair of identical vented load check valves 33 and 34 are disposed within the main motor line 27 to each of the head ends 16 of the jacks 12. The purpose of such load check valves, as will be apparent to those skilled in the art, is to avoid downward drifting of the load due to leakage through the main control valve 21 and to prevent the sudden dropping of the load in the event of a line failure or the like which can result in damage to the load or implement or injury to personnel in the area. For this reason, the load check valves are preferably disposed to their respective jacks. While the schematic diagram of FIG. 1 shows such valves as being somewhat spaced, they are preferably mounted directly on their respective jacks or integral therewith to alleviate the possibility of a line failure between the jacks and the load check valves.

Figure 5:
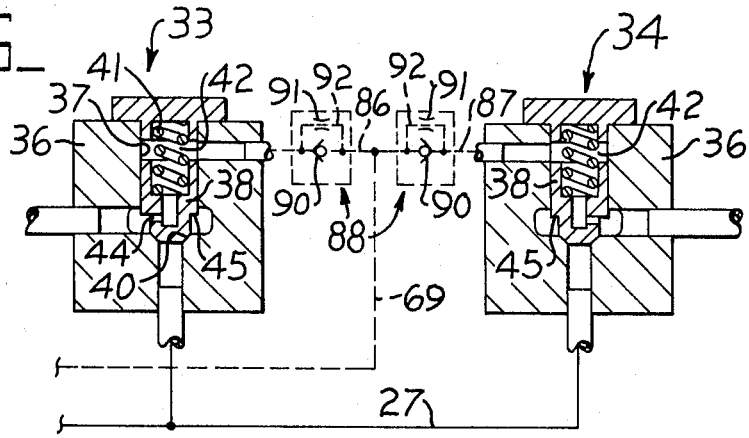
FIG. 5 is a longitudinal cross-sectional view of a pair of load check valves employed in the system of FIG. 1 and further illustrating apparatus to provide pressure equalization in accordance with the principles of the present invention.

While the load check valves may be constructed in any well known manner, they preferably include, as best shown in FIG. 5, a valve body 36 having a valve bore 37 in which a valve member 38 is slidably disposed. The valve member is biased closed against a seat 40 by a spring 41 and fluid pressure in a control chamber 42 in the bore 37 behind the valve member. The control chambers of each of the check valves are pressurized by the fluid pressure in the head ends of their respective jacks which is communicated thereto through an orifice 44 provided in each valve member. Each valve member is also provided with an annular shoulder 45 which is exposed to the load supporting pressure in the head ends of the jack. The pressure acting on such shoulders generates a valve opening force on the valve member. Such opening force, however, is incapable of overcoming the closing force of the fluid pressure in the control chamber due to its greater effective area, unless the control chamber is vented.

As will be hereinafter more fully described, the control circuit 13 is provided with venting apparatus generally indicated at 47 for selectively venting the control chambers of the load check valves, which apparatus includes a pilot operated venting valve 48.

A pilot control system, indicated generally at 50, is provided for selectively simultaneously controlling the operation of the main control valve 21 and the venting valve 48. The pilot system includes a pilot pump 51 connected for drawing fluid from the reservoir 19 for supply of fluid pressure to a pilot control valve 52 through a line 53. The pilot control valve 52 communicates with the reservoir through a second line 54. A relief valve 55 is similarly disposed between the lines 53 and 54 to limit the maximum pressure in the pilot system to a predetermined level. The pilot control valve is further communicated with the opposite ends of the main control valve 21 by way of pilot lines 56 and 57. The pilot line 56 is also connected to the venting valve 48 to communicate pilot fluid therewith when pilot pressure is directed to the control valve 21 to shift the control valve to its B or jack lowering position. It is important to note that the pilot control valve 52 is of the modulating type so as to be able to direct variable amounts of pilot pressure to the main control valve 21 and the venting valve 48 and that the main control valve is constructed so as to require a predetermined pilot pressure in order to be shifted to its B position. Such predetermined pressure is preferably approximately 100 psi.

Figure 2:
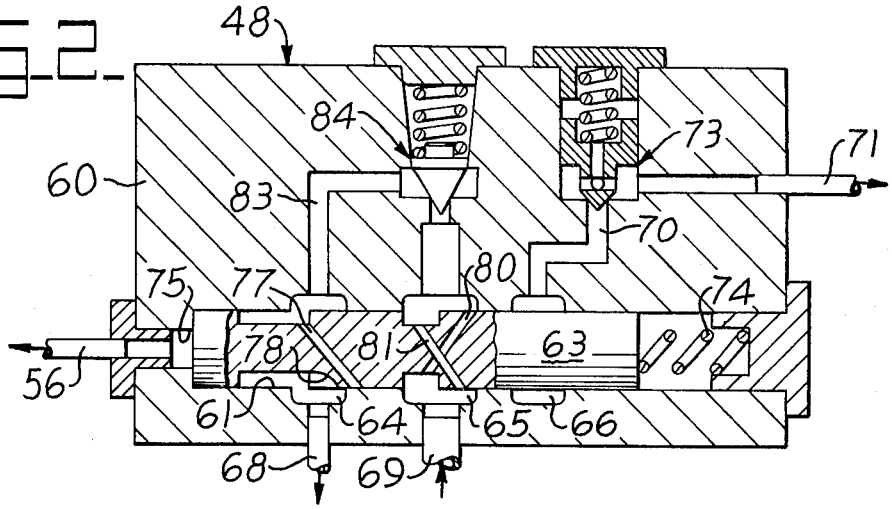
FIG. 2 is a longitudinal cross-sectional view of a load check venting valve employed in the system of FIG. 1 and shown in its neutral position.
Figure 3:
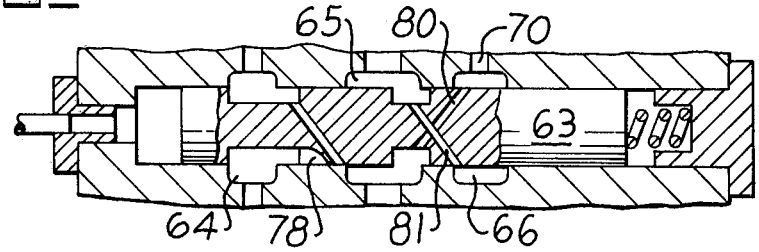
FIGS. 3 and 4 are fragmentary cross-sectional views of the valve of FIG. 2, but showing the valve in its various operative positions.
Figure 4:
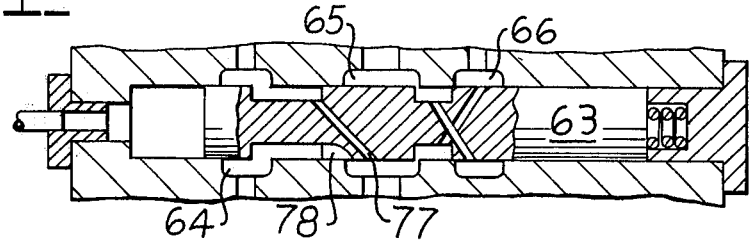

The preferred construction of the venting apparatus 47 will now be described. As best shown in FIGS. 2 through 4 and particularly FIG. 2, the venting valve 48 includes a valve body 60 having a valve bore 61 therein for reciprocably mounting a valve spool 63. The bore is provided with three axially spaced annuli 64, 65 and 66. The first annulus 64 is connected to the reservoir 19 by way of a tank line 68. The second annulus 65 is connected to the control chambers 42 of the load check valves 33 and 34 by way of a vent line 69. The third annulus 66 is connected by way of a passage 70 in the valve body and a connector line 71 to the main control line 27 connected to the head ends 16 of the jacks 12. A check valve 73 is disposed within the passage 70 for freely admitting fluid to the connector line 71 but preventing flow in the opposite direction.

The valve spool is normally biased to a first or neutral position shown in FIG. 2 by a spring 74. The valve body 60 has a pilot inlet port 75 which is connected to the pilot line 56 for communicating pilot pressure against one end of the valve spool to shift the spool toward the right as shown in the drawings to a fully shifted position shown in FIG. 4. The valve spool 63 is provided with passage means including an angular passage 77 and a metering slot 78 for interconnecting the second annulus 65 with the first annulus 64 to permit the venting of the load check valves 33 and 34 to allow their opening. However, the valve spool is also provided with an intermediate position, shown in FIG. 3, between the neutral and fully actuated positions of FIGS. 2 and 4, respectively. The valve spool is provided with passage means including a pair of staggered angularly disposed passages 80 and 81 for interconnecting the second and third annuli when the spool is in its intermediate position. Thus the fluid pressure in the vent line 69 is communicated to the main control line 27 through the connector line 71 and the passage 70.

The venting valve 48 is also provided with a passage 83 interconnecting the first and second annuli which passage is provided with a relief valve 84 for purposes hereinafter disclosed and is designed to open at a pressure somewhat lower than the opening pressure of the main line relief valve 30.

As best shown in FIG. 5, the vent line 69 is provided with a pair of branch lines 86 and 87 for individually connecting the vent line with the load check valves 33 and 34, respectively. Each branch line is provided with a choke and check device 88. Each device includes a check valve 90 disposed within its respective branch line for freely admitting fluid from its respective load check valve, but preventing flow in the opposite direction. The devices also include an orifice 91 disposed in a bypass line 92 for allowing a restricted amount of flow to their respective load check valves. Such check and choke devices are utilized to permit pressure equalization between the respective head ends of the jacks 12 to prevent implement cocking or uneven jack operation without the use of a separate small equalizer line as commonly employed in prior art systems for such purpose. As is readily apparent, flow between the head ends of the jacks is effectively restricted by three orifices in each direction, including the orifices 44 of each load check valve and a respective one of the orifices 91 of the choke and check devices.

Operation

While the operation of the present invention is believed to be clearly apparent from the foregoing description, further amplification will be subsequently made in the following brief summary of such operation. In operation, when it is desired to lower a load being supported by the jacks 12, the pilot control valve 52 is manually shifted to direct pilot pressure through the pilot line 56 to the main control valve 21. It will be appreciated that such pilot pressure is also simultaneously directed to the venting valve 48. As the pressure needed to shift the venting valve to its intermediate position is substantially less than the predetermined pressure needed to shift the control valve to its jack lowering position, the valve spool interconnects the second and third annuli prior to the communication of the main control line 27 to the reservoir 19 by the main control valve 21. Thus, the load generated pressure in the head ends 16 of the jacks 12 is communicated to the main control line 27 via the orifices 44 and the control chambers 42 of the load check valves 33 and 34, the respective branch lines 86 and 87 and vent line 69, the passage 70 of the venting valve and the connector line 71. As a result, the main control line 27 is prepressurized by the load generated pressure in the head ends of the jacks so that a pressure balance exists on the opposite sides of the load check valves before such check valves are open to prevent the pressure surge and consequent hammering and momentary load drop occurring in prior art systems. It will be further appreciated that the metering passages 80 and 81 of the valve spool 63 are effective in modulating such prepressurization.

As the pilot pressure increases to the predetermined pressure necessary to shift the main control valve 21, the valve spool 63 of the venting valve is shifted through its intermediate position to its venting position, as shown in FIG. 4. The venting valve is provided with the annular passage 77 and the metering slot 78 so that the opening of the load check valves is also modulated. The venting valve is constructed to fully vent the load check valves just prior to the shifting of the main control valve so that the load generated pressure is present at the main control valve and stabilized so that the load can be smoothly lowered in a controlled manner.

Once the main control line 27 is prepressurized by the venting valve, the loss of such pressure, as when the spool moves to its venting position, is prevented by the check valve 73.

When the pilot control valve is returned to its neutral position, the pilot pressure to the main control valve 21 and to the venting valve 48 is relieved, thus allowing such valves to return to their neutral position. When in its neutral position, the main control valve blocks the main control lines 27 and 28 so as to cease pump flow to the rod ends of the jacks and to cease the return of fluid from the head ends to the reservoir. The venting valve ceases the venting of the load check valves to permit their closing.

However, if the load check valves are permitted to close when a heavy load is being lowered rapidly, extremely high pressure spikes can develop in the head ends of the jacks which may be injurious to the jacks and its related components. The present invention alleviates such pressure spikes and the consequent damage to the jacks by providing the relief valve 84 in the venting valve 48. Such relief valve is constructed to open at a pressure somewhat below the opening pressure of the main line relief valve 30 in the main control line 27. Thus, when the main control valve 21 is shifted to block the further escape of fluid from the head ends of the jacks, the resultant rapid buildup of pressure will be experienced against the relief valve 84 through the load check valves and the vent line 69. Thus, the relief valve 84 will open to continue the venting of the control chambers 42 of the load check valves to prevent their closing. The load check valves will remain open as long as the pressure is above the opening pressure of such relief valve which makes it possible for the fluid to be relieved through the main line relief valve 30. It will be appreciated that because of the size of the vent line 69 and the restrictions therein, only a small amount of fluid flow is possible therethrough which is insufficient to prevent the pressure spike. Therefore, it is necessary that the load check valves be open so as to permit fluid flow to the reservoir through the main line relief valve 30. Thus, from the above it can be seen that the heavy load is stopped in a controlled manner without any adverse effects on the system.

The choke and check devices 88, besides permitting the previously mentioned pressure equalization between the respective head ends 16 of the jacks 12, also advantageously insure the simultaneous closing of the load check valves 33 and 34. As those skilled in the art will appreciate, one of such load check valves may have a tendency to close a short time before the other when the load is stopped during lowering due to differences in manufacturing tolerances or various other conditions. When this happens, the jack with the load check valve closing first is made to momentarily support the entire load which can produce injurious pressure spikes, as when stopping a heavy load too abruptly. This is alleviated by the choke and check devices 88 by permitting the communication of fluid pressure between the respective control chambers 42 of the load check valves 33 and 34. As a consequence, when one of the load check valves closes, the instantaneous pressure buildup in the head end of the associated jack is experienced in the control chamber of such valve. Such pressure is communicated through the choke and check devices to the control chamber of the other load check valve so as to effect its closing also.

Thus, as is readily apparent from the foregoing, the particular construction of the present hydraulic load lifting system fully satisfies the objects of the present invention by alleviating hydraulic hammering through the prepressurization of the main control line prior to the opening of the load check valves. The injurious pressure spikes are alleviated by utilizing a relief valve in the vent line to keep the load check valves open as long as pressure in the load supporting ends of the jacks is sufficiently high to open the main line relief valve. Also, as mentioned previously, the use of the choke and check devices 88 permits pressure equalization through the vent line between the head ends of the jack without the need of a separate equalizer line for such purpose.

While the invention has been described and shown with particular reference to the preferred embodiment, it will be apparent that variations might be possible that would fall within the scope of the present invention, which is not intended to be limited except as defined in the following claims.

What is claimed is:

1. In a hydraulic load lifting system including hydraulic motor means having a load supporting end, a source of pressurized fluid, a main control valve having load raising, lowering and holding positions, and a main control line for communicating fluid between the control valve and the load supporting end of the motor means, the improvement comprising:

vented load check valve means disposed within said main control line adjacent said hydraulic motor means to freely admit fluid to the load supporting end of the hydraulic motor means when the control valve is in its load raising position and to block fluid flow therefrom when the control valve is in its load holding position;

venting means for selectively venting the load check valve means when the control valve is in its load lowering position to allow fluid to escape from the load supporting end of the motor means; and means for selectively prepressurizing the main control line between said control valve and the load check valve means to a pressure substantially equal to the pressure at the load supporting end of the motor means immediately prior to the venting of the load check valve means so that a fluid pressure balance exists on the opposite sides of the load check valve means when said valve means opens so as to prevent momentary load drop and hydraulic hammering.

2. The hydraulic load lifting system of claim 1 wherein said load check valve means includes a control chamber and restriction means communicating fluid pressure from the load supporting end of the motor means to said control chamber to effect the closing of said load check valve means.

3. The hydraulic load lifting system of claim 2 wherein said venting means and said means for selectively prepressurizing said main control line includes a single venting valve, a vent line for connecting the venting valve with said control chamber, a tank line for exhausting fluid from the venting valve to said source, and a connector line interconnecting said venting valve with said main control line.

4. The hydraulic load lifting system of claim 3 wherein said venting valve includes neutral, intermediate and venting positions with the valve passing through its intermediate position when shifted between its neutral and venting positions wherein fluid in the vent line is communicated to the connector line to effect the prepressurization of the main control line.

5. The hydraulic load lifting system of claim 4 wherein said venting valve further includes a passage for communicating fluid to said connector line with said passage having check valve means disposed therein for freely admitting fluid to the connector line but preventing flow in the opposite direction to prevent the loss through the venting valve of pressure in the main control line after being prepressurized.

6. The hydraulic load lifting system of claim 5 including a main line relief valve connected to said main control line and wherein said venting valve includes relief valve means interconnected between the vent line and said tank line, said relief valve means having an opening pressure slightly below the opening pressure of said main line relief valve and being operative to prevent high pressure spikes from occurring in the motor means by keeping the load check valve means open as long as high pressure above the main line relief valve opening pressure exists so that such high fluid pressure can escape through the main line relief valve.

7. The hydraulic load lifting system of claim 6 wherein said control valve and said venting valve are pilot operated and said system includes pilot means for simultaneously controlling said control and venting valves and wherein said control valve is positionable to its load lowering position at a predetermined pilot pressure and said venting valve is positionable in its intermediate position at a pilot pressure substantially below said predetermined pilot pressure so that said prepressurization occurs prior to the shifting of the control valve.

8. The hydraulic load lifting system of claim 7 wherein said venting valve is positionable in its venting position at a pilot pressure slightly less than said predetermined pilot pressure to effect the opening of the load check valve immediately prior to the shifting of the control valve so that the load generated pressure at the load supporting end of the motor means is present at the control valve and substantially stabilized when it shifts so that the load can be smoothly lowered in a more controlled manner.

9. The hydraulic load lifting system of claim 8 wherein said motor means includes a pair of double acting hydraulic jacks having load supporting head ends and opposite rod ends and wherein said load check valve means includes a pair of load check valves individually connected to respective ones of the head ends of such jacks and said vent line includes a pair of branch lines individually connected to such load check valves and including choke and check means disposed within said branch lines for permitting pressure equalization between the head ends of said jacks to afford uniform operation thereof.

10. The hydraulic load lifting system of claim 9 wherein said venting valve includes means for modulating the communication of fluid from the vent line individually to the tank line and the connector line to provide greater stability of operation.

11. A hydraulic load lifting system comprising in combination:

hydraulic motor means for raising and lowering a load and having a predetermined load supporting end;

a fluid reservoir;

a pump connected for drawing fluid from said reservoir;

a pilot operated main control valve independently connected to said pump and said reservoir and having hold, raise and lower positions, said control valve requiring a predetermined pilot pressure for shifting from its hold position to its lower position;

a main control line interconnecting the main control valve with the load supporting end of said motor means;

vented load check valve means disposed within said main control line near said motor means for freely admitting fluid into said load supporting end thereof and having a control chamber and restriction means to communicate fluid pressure from the load supporting end to said chamber for normally closing the load check valve means to prevent the escape of fluid from the load supporting end and means operative to open the load check valve means when such chamber is being vented;

load check valve venting means including a pilot operated venting valve, a tank line for interconnecting the venting valve with the reservoir, a vent line for interconnecting said venting valve with the control chamber of the load check valves, and a connector line for interconnecting the venting valve with the main control line;

pilot control means including a source of pressurized pilot fluid and a pilot control valve for simultaneously controlling said main control valve and said venting valve to effect the exhausting of fluid from the load supporting end of said motor means for lowering said load; and said venting valve having a normal blocking position, an intermediate position and a venting position, said venting valve being positionable by said pilot control means from its blocking position to its intermediate position at a pilot pressure substantially lower than said predetermined pilot pressure for shifting said main control valve wherein fluid pressure in said vent line is communicated to connector line so as to prepressurize the main control line prior to the venting of the load check valve means so that pressure is substantially balanced on the opposite sides of said load check valve means to prevent momentary load drop and hydraulic hammering.

12. In a hydraulic load lifting system including a pair of hydraulic jacks each having a load supporting end, and a control circuit having a source of pressurized fluid, a main control valve and a main control line for communicating fluid between the control valve and each of the load supporting ends of the jacks, the combination comprising:

a pair of vented load check valves individually disposed within the main control line adjacent a respective one of said jacks, said load check valves being operative to freely admit fluid to their respective jacks and including a control chamber and restriction means communicating fluid pressure from the load supporting end of their respective jacks to their control chambers for effecting the closing of such load check valves to normally prevent the escape of fluid therefrom except when said chambers are vented;

means for selectively venting the load check valves to allow fluid to escape from the load supporting ends of the jacks;

means for selectively prepressurizing said main control line between said control valve and the load check valves prior to the venting of the load check valves and the shifting of the control valve to effect the lowering of a load being supported by said jacks so as to substantially balance the pressures on the opposite sides of the load check valves for preventing momentary load drop and hydraulic hammering, and including vent line means interconnected between the control chambers of said load check valves; and choke and check means disposed within said vent line means for permitting pressure equalization between the head ends of said jacks and operative to communicate fluid pressure from the control chamber of one of said load check valves to the control chamber of the other to effect the simultaneous closing of such load check valves.

* * * * *